US007900618B1

(12) United States Patent
Angermeier

(10) Patent No.: US 7,900,618 B1
(45) Date of Patent: Mar. 8, 2011

(54) BALL THROWING MACHINE CONVERSION FOR PITCH CHANGE

(76) Inventor: Donald W. Angermeier, Owensville, IN (US)

( * ) Notice: Subject to any disclaimer, the term of this patent is extended or adjusted under 35 U.S.C. 154(b) by 570 days.

(21) Appl. No.: 11/959,594

(22) Filed: Dec. 19, 2007

Related U.S. Application Data

(60) Provisional application No. 60/883,103, filed on Jan. 2, 2007.

(51) Int. Cl.
*F41B 4/00* (2006.01)

(52) U.S. Cl. ..... 124/6

(58) Field of Classification Search ..... 124/6, 78
See application file for complete search history.

(56) References Cited

U.S. PATENT DOCUMENTS

| | | | | |
|---|---|---|---|---|
| 1,211,738 | A | 1/1917 | Marty | |
| 2,189,288 | A | 2/1940 | Heyer | |
| 3,878,827 | A | 4/1975 | Newgarden, Jr. | |
| RE30,703 | E | 8/1981 | Paulson et al. | |
| 4,323,047 | A | 4/1982 | McIntosh et al. | |
| 4,705,014 | A | 11/1987 | Kahelin | |
| 5,012,790 | A * | 5/1991 | Bates | 124/81 |
| 5,826,568 | A * | 10/1998 | Van Ross, Jr. | 124/6 |
| 5,832,909 | A | 11/1998 | Grant et al. | |
| 6,402,640 | B1 * | 6/2002 | Stuart | 473/422 |
| 7,383,832 | B2 * | 6/2008 | Soberg | 124/6 |

* cited by examiner

*Primary Examiner* — John Ricci

(74) *Attorney, Agent, or Firm* — Woodard Emhardt Moriarty McNett & Henry LLP

(57) ABSTRACT

Embodiments of the present invention involve modification of a type of existing ball throwing machine to add the ability to quickly change the type of throw between one and another in a sequence of throws. One illustrated embodiment involves modification of existing components and adding some to the existing machine to add the performance feature. Another illustrated embodiment involves less modification the existing machine but obtaining the performance feature with pre-assemblies of components.

23 Claims, 8 Drawing Sheets

BALL THROWING MACHINE CONVERSION FOR PITCH CHANGE

The application is based on provisional patent application U.S. Provisional Patent Application No. 60/883,103 filed Jan. 2, 2007, on which priority for the present application is claimed, and which is incorporated herein by reference.

BACKGROUND OF THE INVENTION

This invention relates generally to ball throwing apparatus, and more particularly to such apparatus having a single-throwing wheel.

Over the years, various types of ball throwing devices have been developed to facilitate hitting practice by tennis players, batting practice by baseball and softball players, and practice in other sports in which hitting a moving ball is involved. Some throwing machines are very sophisticated and, as a result, are relatively expensive. Considering the limited funds available to individuals, some educational organizations, some amateur sports organizations, and some businesses, there has been a need for less costly devices. As a result, less expensive machines have been available, but with some limitations in their capabilities compared to the more expensive machines. The present invention is addressed to adding some capability to existing machines at a cost within the reach of a greater number of people and organizations than in the past.

A U.S. Pat. No. Re. 30,703 issued Aug. 11, 1981 discloses a ball throwing device of a type to which the present invention is applicable, whereby the device is made more versatile.

SUMMARY

Embodiments of the present invention involve modification of a type of existing ball throwing machine to add the ability to quickly change the type of throw between one and another in a sequence of throws.

DESCRIPTION OF THE ILLUSTRATED EMBODIMENTS

Figure 1:
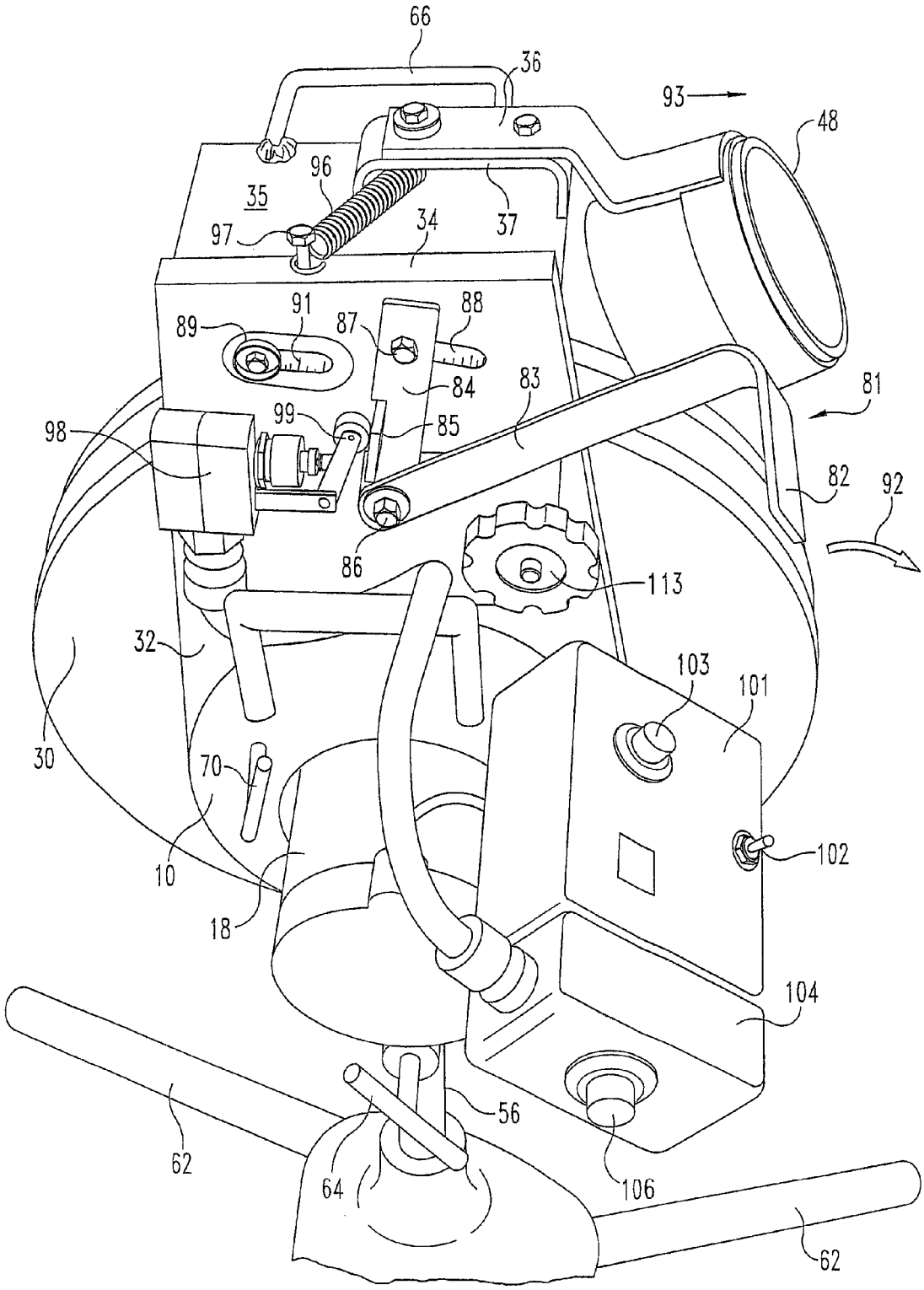
FIG. 1 shows a ball throwing machine viewed from above and left side and modified according to one embodiment of the present invention.
Figure 3:
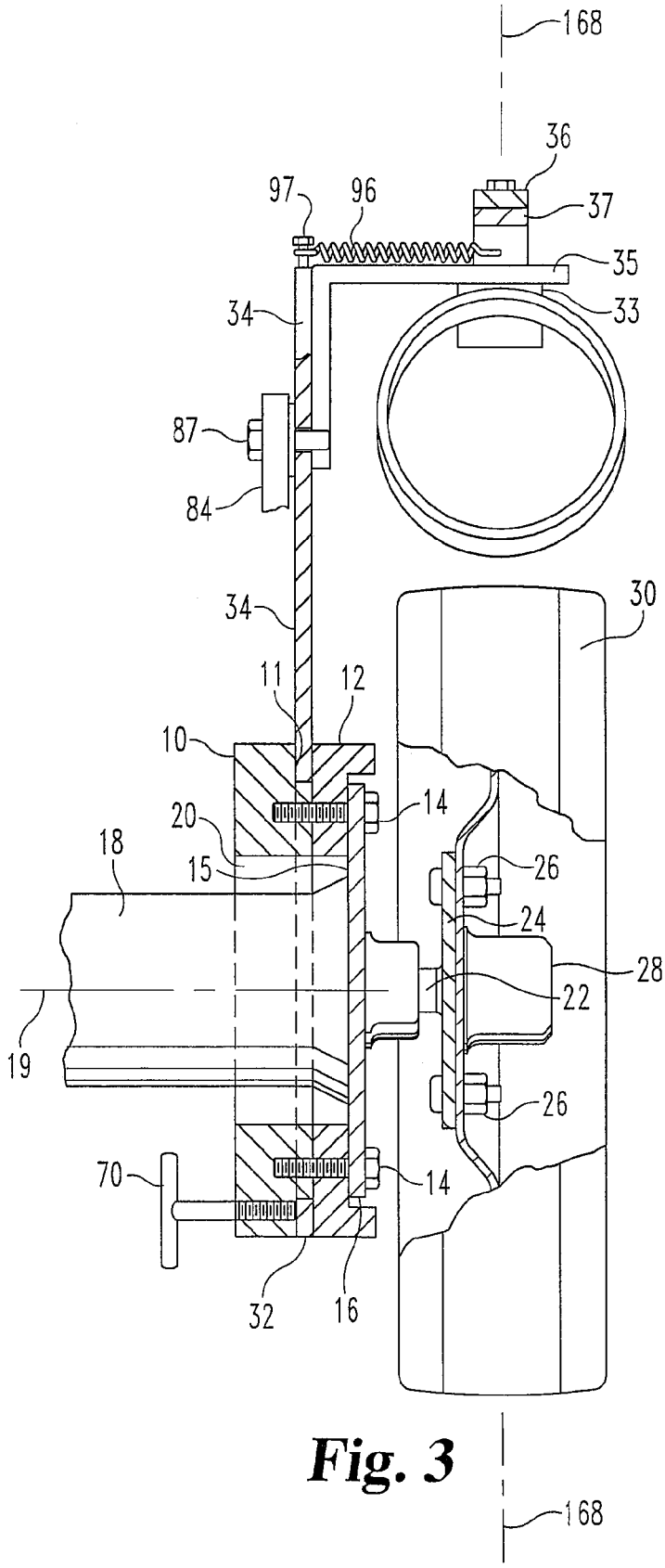
FIG. 3 is a fragmentary rear elevation view with a portion shown in section taken at line 3-3 in FIG. 2 and viewed in the direction of the arrows.

Before referring to the drawings in detail, reference is made to the description of the above-mentioned ball throwing device in Pat. No. Re. 30,703 issued Aug. 11, 1981, the description of which is incorporated herein by reference to the extent it can be helpful. A subsequent model of that device has been marketed by The Jugs Company of Tualatin, Oreg. It is now modified by me according to embodiments of my present invention as shown on the drawings herein. Therefore, some reference numerals used for parts in that patent are used in this application as well. For example, there is a base assembly which, as shown in FIG. 3, includes two generally circular base portions 10 and 12 which are sandwiched together with an end plate 15 of motor 18, and fastened together by bolts 14, so the base portions are generally circular about an axis which is also the rotational axis 19 of the motor output shaft 22. Pneumatic-tired wheel 30 is fastened to the motor output shaft for rotation in the plane 168 which is perpendicular to said axis 19. Also, there is a circumferential groove 11 in the base portion 10 and which is also centered on the axis 19. The base assembly is mounted to the shaft 56 of a tripod which has legs 62. The height of the base assembly on the tripod can be adjusted by the handle 64 of a set screw which clamps onto the shaft 56 (FIG. 1).

Figure 2:
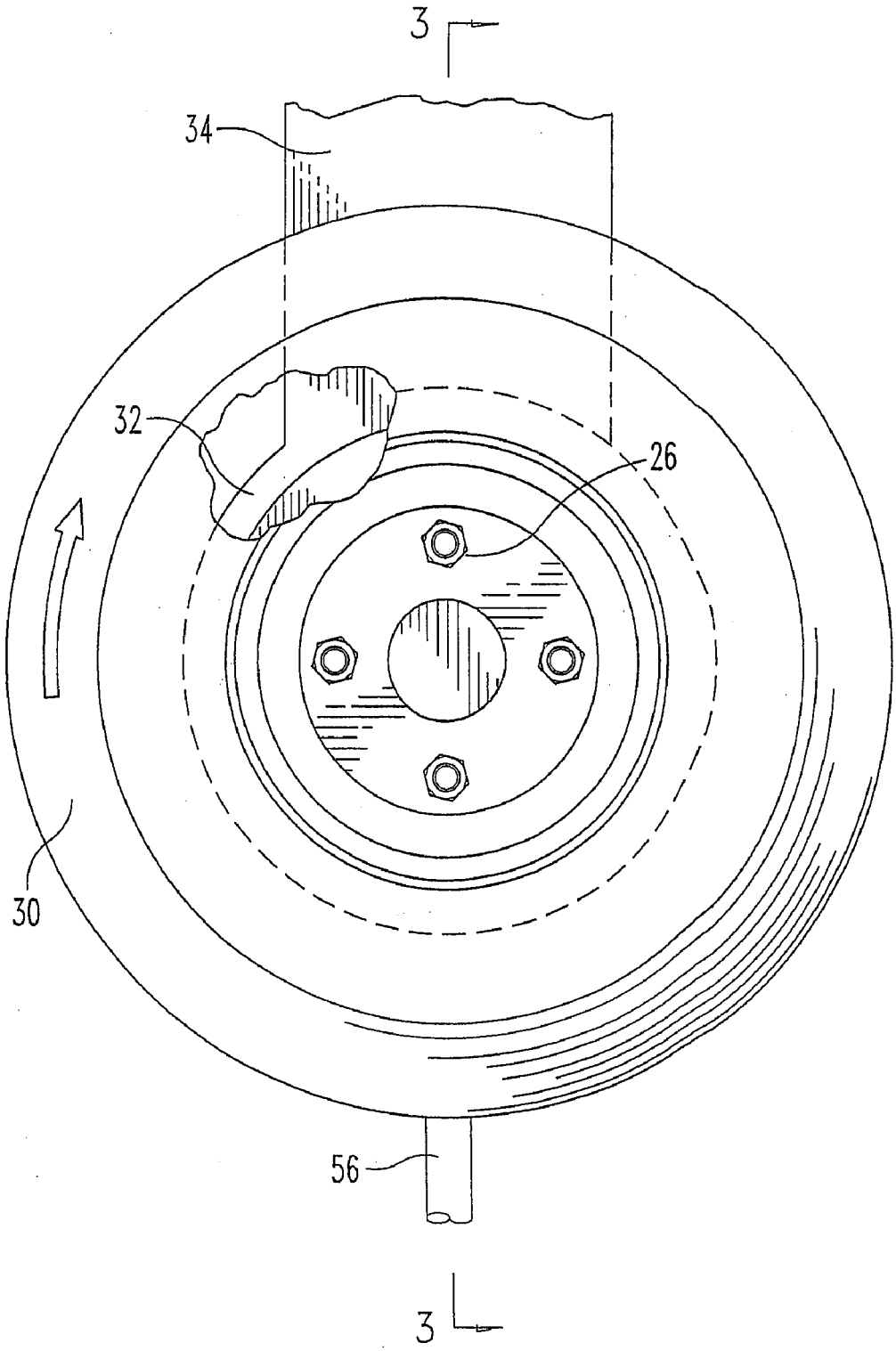
FIG. 2 is a fragmentary elevation view with portions broken out to show internal details.

A support member 34, shown as a plate, has a ring end portion 32 such as shown in FIG. 2 and which is received in the circumferential groove 11 of the base portion 10. So the member 34 can be rotated on the base portion 10 about the rotational axis 19 of the motor shaft. The ring end portion 32 of member 34 can be clamped to base portion 12 by turning the T-handle 70 of a clamp screw which is screwed into the base portion 10 and clamps the ring portion 32 against the base portion 12. Because of this construction of the member 34, the member can be rotated completely around to the position shown in the broken lines in FIG. 2 of the patent, if desired.

Referring to FIG. 3 herein, an L-shaped bracket 35 is mounted on the wheel side of the member 34. It has a rubber pad 33 similar to 42 of the patent, glued or otherwise fastened to the bottom of bracket 35. A ball feed chute 48 is mounted to an arm 36 which is bolted at two places to a support bridge 37 which is fastened to the top of the bracket 35. But according to this embodiment of the present invention, the bracket is not fixed to member 34. Instead of the conventional mounting of the bracket 35 rigidly to the member 34, it is mounted to be moveable to the rear in the direction of arrow 93 (FIG. 1) relative to a member such as 34, according to one aspect of the present invention.

According to another aspect of the FIGS. 1-5 embodiment of the present invention, there is a change initiator. In this embodiment, this feature is implemented by a changer 81 which includes a handle portion 82, an arm 83, and a crank portion 84. In the illustrated example, the changer 81 is a rigid unit pivotally mounted to the near side of member 34 by means of a bolt 86 screwed into the member 34. In the FIGS. 1-5 embodiment, another bolt 87 is mounted near the distal end of the crank portion 84 and is received through a slot 88 in member 34 and screwed into the downwardly-turned face of bracket 35 that is at the far (wheel) side of member 34. Another bolt 89 is received through a slot 91 in member 34 and is screwed into the down-turned face of bracket 35. Therefore, the changer handle 82 can be pulled rearward and downward around the pivot bolt 86 in the direction of arrow 92 and pivoting about the bolt 86. As the changer turns around the bolt 86, it will pull the bracket 35 in the direction of arrow 93, thus re-locating the feed chute 48 relative to the wheel 30. This will cause the ball being thrown off the wheel to fly upward at a steeper angle relative to horizontal than when the member 34 is in the position shown in FIG. 1 where the bolts are at the front end of the slots 91 and 88. It should be noted in FIG. 1 that the slots 88 and 91 slope downward as they extend rearward. This is done so that the gap between the periphery of the wheel and the pad 33 and the discharge chute 48 remains practically the same while the chute is pulled backward. If desired for more precise spacing, the slots can be curved on radii centered on axis 19.

One of the bolts 66 fastening the arm 36 to the bridge 37 also fastens one end of a spring 96 to the bracket 35. The other end of the spring is fastened to the member 34 by a bolt 97. This spring operates to return the bracket 35 to the rest position shown in FIG. 1, when the changer handle 82 is released.

In accord with another aspect of the present invention, a motor speed changing system is provided. In the embodiment of FIGS. 1-5, this includes a switch assembly 98 fixed to the member 34 and which has a roller 99 engaged by a tab 85 fixed on the crank portion 84 of the changer 81. When the apparatus is in the rest position of the bracket 35, this switch is held closed by the tab 85. However, when the handle 82 is pulled back, it pulls the tab back, allowing the switch to open. This results in a change of the wheel speed as will be described now.

Figure 5:
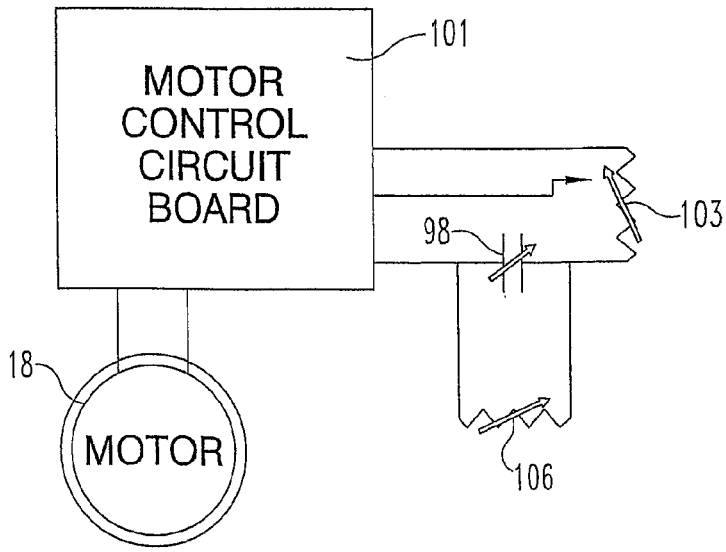
FIG. 5 is an electrical schematic view of a modification to the electric motor control.

The ball-throwing device as furnished by the original manufacturer, before modification according to the illustrated embodiments of the present invention, is equipped with a motor controller 101. It includes an on-off switch 102, and a speed-adjusting potentiometer 103 whereby the user can adjust the wheel speed as desired. In accord with another aspect of the illustrated embodiments of the present invention, the switch 98 mentioned above is added to the motor control circuitry and an additional speed controller 104 is provided. Controller 104 includes a speed adjusting potentiometer 106 and which is coupled in parallel with switch 98. The switch is normally maintained in the closed position, as shown in FIG. 5. But, the switch 98 is opened as the handle 82 is pulled back in the direction of arrow 93, whereby the potentiometer 106 is added in series in the circuitry, applying more resistance to the motor so that it runs slower. The amount of additional resistance is adjustable by the potentiometer 106. When the handle is released, it is returned by the spring 96 to rest position shown in FIG. 1. This permits the switch 98 to close, by-passing the potentiometer 106, so the original speed controller 101 with its potentiometer is in control, independent of controller 104.

Figure 4:
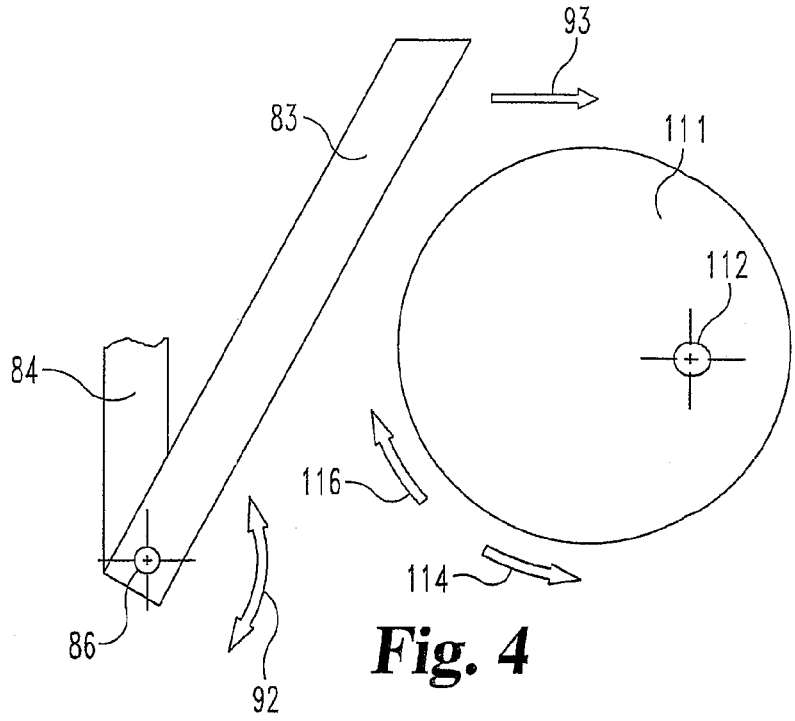
FIG. 4 is an enlarged schematic view showing the relationship of the operating handle and the adjustable stop.

Referring now to FIG. 4, the pivot bolt 86 is shown with the changer arm portion 83 fixed to it and pivotal in the direction of the arrow 92. A stop disc 111 is offset-mounted to a pivot bolt 112 which is screwed into the member 34. A clamp knob 113 affixed to the end of the pivot bolt is operable to clamp the stop disc 111 against the member 34. The purpose of the stop is to limit how far backward in the direction of arrow 93, the feed chute is pulled. It does so by being in a position to engage the handle arm 83. For example, as the adjustable stop is turned in the direction of arrow 114, from the position shown in FIG. 4, the peripheral surface of the stop moves farther away to the right in the direction of arrow 93 so that the handle can be pulled farther in the direction of arrow 93. When the knob 113 is loosened, the stop can be turned either in the direction of arrow 114 or the opposite direction of arrow 116 to change the travel of the arm 83. Then the knob 113 can be tightened to clamp the stop against the face of the member 34 so that whenever the handle is pulled in the direction of arrow 93, the stop will limit how far to the right it can be pulled.

Figure 6:
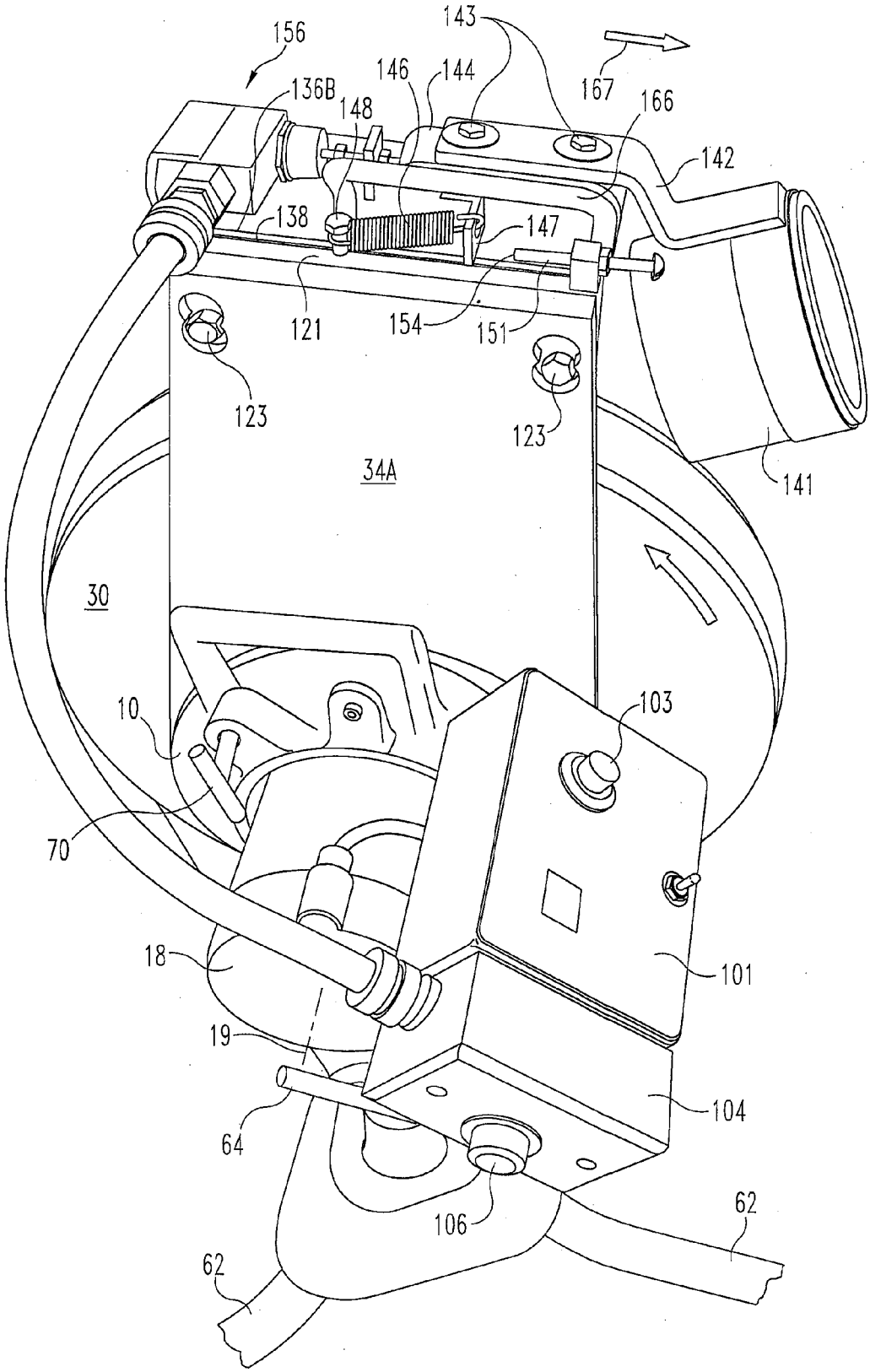
FIG. 6 is a view similar to FIG. 1 but showing a second embodiment of the present invention.

Referring now to the embodiment of FIG. 6 and following, many of the components referred to in the description of the first embodiment are given the same reference numerals. But there are some other features that are different. The base portions 10, 12 and motor and mounting to the tripod can be the same. The feed chute support member 34A is a little different, as the guide slots 88 and 91 shown in member 34 in FIG. 1 are not used in support member portion 34A.

Figure 10:
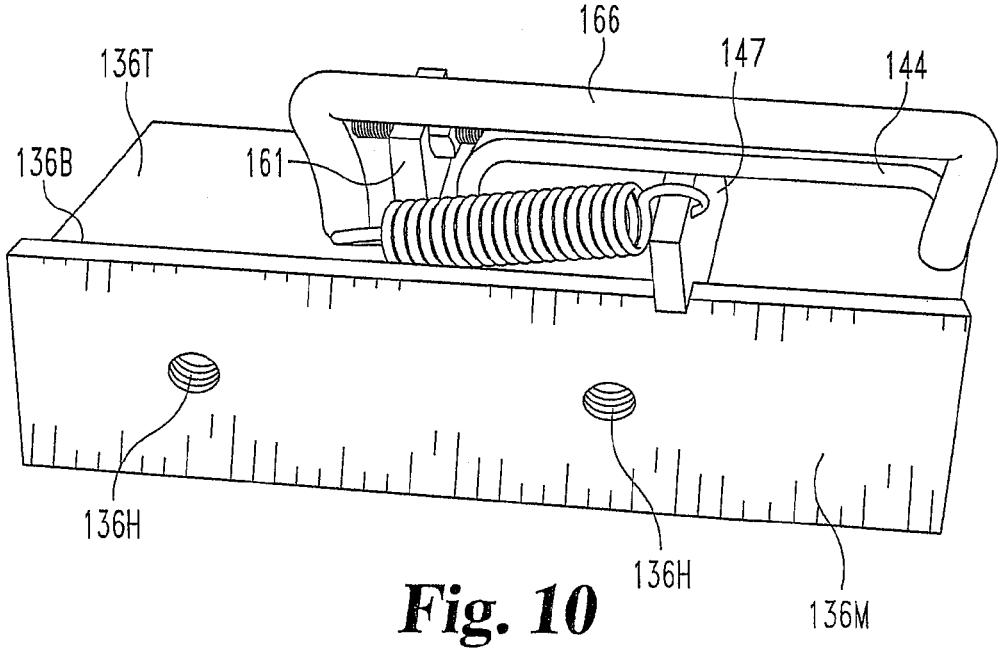
FIG. 10 is a view of the feed chute slide bracket looking toward the inboard mounting face.

There is a feed chute slide mounting block 121 (FIG. 8) to be secured to the support member 34A. This block has two slots 124 through it. A feed chute slide assembly is mounted to the block 121 in a way to enable the slide assembly to be slid on the block. The illustrated slide assembly has a bracket 136 which has a table portion 136A with a pad such as 33 (FIG. 3) glued or otherwise mounted to its underside. A mounting portion 136M (FIG. 10) of the slide bracket extends down from the table portion and has two threaded holes 136H in it.

Before mounting the block 121 to the support member 34A two bolts 137 are installed through the slots 124 in the mounting block 121 and are screwed into the holes 136H in the slide bracket mounting portion 136M to fasten the slide bracket 136 to the mounting block 121. Each of the slots 124 has a perimeter groove 124G in the mounting face of block 121 to accommodate the bolt heads and thereby avoid bolt head interference with the face of the slide bracket mounting portion 136M. The bolts can have thread limits or the holes 136H can be blind holes, or means can be used to prevent the bolt heads from clamping against the faces of the grooves 124G. Therefore, although the slide bracket 136 is connected to the slide mounting block 121 by the bolts 137, the slide is able to slide relative to the mounting block in the direction of the slots 124.

The mounting portion 136M of the slide bracket 136 has a face piece 138 of low friction face material (Teflon®, for example) so that the slide bracket 136 can slide freely on the block 121 between limits dictated by the length of the slots 124 in the slide mounting block, and an adjustable limit as will be described.

The slide mounting block 121 has threaded holes 122 and is bolted to the wheel side of the support member 34A by bolts 123 (FIG. 6) through unthreaded holes in the support member 34A. The heads of bolts 123 seat in recesses in the face of member 34A. Ball feed chute 141 is supported by arm 142 fastened by two bolts 143 to support bridge 144 welded to the table top 136T, so the ball feed chute is movable by and to the extent that the slide bracket 136 is movable.

Since mounting block 121 is bolted to the support member portion 34A with bolts 123, the mounting block 121 becomes part of the support member in this environment, serving to provide the bracket slide guide function.

A return spring 146 has one end loop hooked to an anchor tab 147 fixed to the slide bracket 136 and the other end loop hooked to an anchor bolt 148 mounted in the top of the mounting block 121. This spring holds the slide bracket in the stable rest position shown in the drawing FIGS. 6 and 7.

Figure 8:
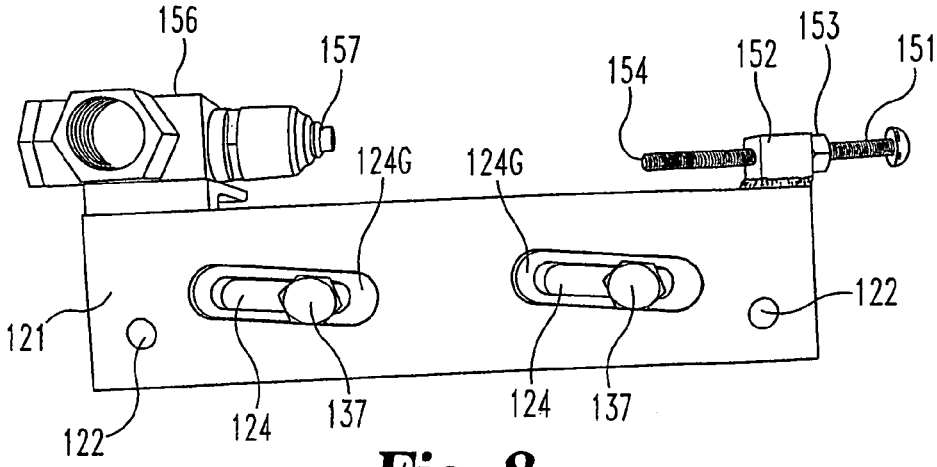
FIG. 8 is a view of a stationary mounting block for the feed chute slide bracket.

Referring particularly to FIG. 8, a stop screw 151 is received in a threaded hole in a tab 152 fixed to the mounting block 121 and has a nut 153 on it to clamp against the tab 152 when a desired adjustment of the screw has been made. The distal end 154 of the screw faces the tab 147 to which one end of the spring 146 is hooked, as mentioned above. The screw serves as a stop of travel of the slide bracket 136 when the slide bracket is moved backward from rest position.

Figure 7:
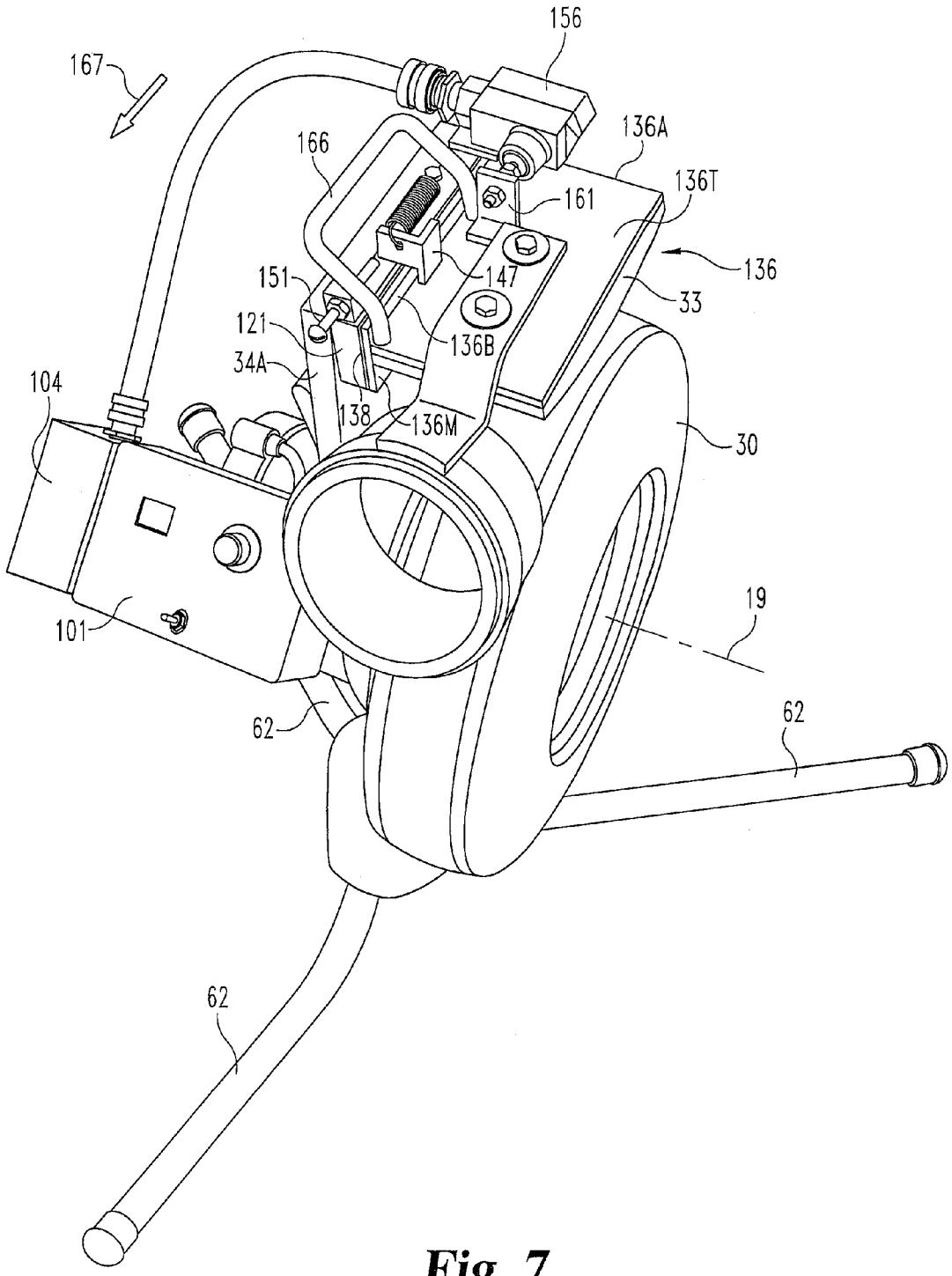
FIG. 7 is shows the second embodiment viewed from above and showing the rear and right side.
Figure 9:
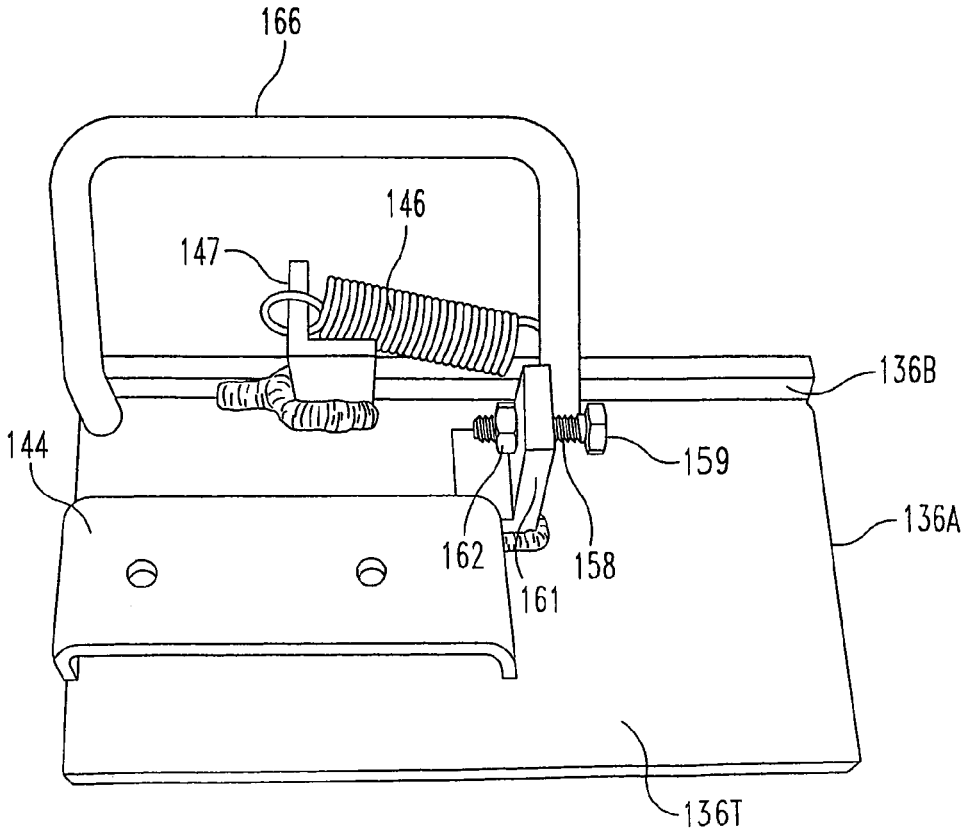
FIG. 9 is a view of the feed chute slide bracket looking toward the outboard edge.

A switch assembly 156 has a housing fixed to the mounting block 121 and has a plunger 157. Referring to FIG. 9, a switch plunger stop screw 158 has a head 159 engaged with the plunger (FIGS. 6, 7). The screw is threaded into the tab 161 fixed to the slide bracket 136. A nut 162 is provided on the screw to clamp against the tab to maintain a desired adjustment.

The electrical coupling of the switch assembly 156 to the motor controller is the same as that for the switch assembly 98 and the potentiometer 106 of FIG. 5.

This embodiment of the present invention provides a kit which makes conversion very simple. One portion provides the controller 104 for simple connection to the existing motor controller 101, with the cable and switch assembly for easy mounting to an existing support member. The other portion provides a slide mounting member 121 easily mounted to the existing support member, and having a slide bracket 136 with a variety of components and including a feed chute already mounted to it and slide-able on the mounting member. In the use of this embodiment of the invention, after making the modifications described above, the operator can simply change the motor speed and the location of engagement of the ball with the wheel by pulling the handle 166 backward in the direction of arrow 167. The adjustment screw 151 can be set to limit how far the slide can be pulled back, because the slide bracket is stopped by the tab 147 on the slide bracket hitting the end of the screw 151. Upon release of the handle, the spring 146 will return the slide bracket to the rest position. The triggering of the switch 156 to open occurs as the slide bracket is pulled back, which moves the switch plunger stop screw in a direction away from the switch 156. The location of the slide bracket to cause the triggering event is adjustable by adjusting the screw 158.

The slots 124 are slanted downward from front to rear so that the attitude of the feed chute changes as the slide bracket is pulled backward, to introduce the ball to the wheel 30 at a lower level and start the trajectory of the ball at a higher angle than when the slide bracket is in the rest position to which the spring returns it when the handle 166 is released. The slots can be curved if desired as discussed above for the slots 88 and 91 of the embodiment of FIGS. 1-5.

In the foregoing description, various terms including, but not limited to; tabs, screws, nuts, table, plate, block, weld and the like, are used. It should be understood that other terms could be used to describe such items or items serving the same purpose, so the use of such terms should not be construed as limited to precisely the details of what is shown in the drawings.

Therefore, while embodiments of the invention have been illustrated and described in detail in the drawings and foregoing description, the same is to be considered as illustrative and not restrictive in character, it being understood that all changes and modifications that come within the spirit of the invention are desired to be protected.

What is claimed is:

1. In a ball throwing device comprising:

a support member, a wheel mounted on the support member above ground for rotation in a first plane about an axis perpendicular to said plane and wherein the wheel has a perimeter surface that is circular and is centered on said axis and faces outward away from said axis for engagement of a ball when placed on said surface, a motor for rotating the wheel on said axis for enabling the said surface of the wheel to throw said ball in a first direction in said first plane at a speed predetermined to project said ball from the surface of the wheel at a selected velocity;

a bracket attached to said support member;

a ball feed chute mounted to said bracket and radially spaced from said axis at a distance greater than the distance of said perimeter surface of the wheel from said axis;

and a pad secured to said bracket and having a ball-engagable surface spaced radially outward from said perimeter surface of the wheel a distance slightly less than the diameter of a ball to be thrown, for compressing the ball against the wheel;

the improvement comprising:

attachment of the bracket to the support member so that the bracket is moveable relative to said support member around said axis; and a motor control switch coupled to said motor and responsive to sliding of said bracket relative to said support member to change the speed of said motor.

2. The improvement of claim 1 and wherein:

said bracket has a first position placing said feed chute relative to said support member to cause said wheel to throw said ball in said first direction, and said bracket has a second position placing said feed chute relative to said support member to cause said wheel to throw said ball in said second direction upward from said first direction.

3. The improvement of claim 2 and wherein:

said switch is associated with said bracket and is operable in response to movement of said bracket from said first position to said second position, to change the speed of the motor from a first speed causing the wheel to throw the ball in the first direction, to a lower speed to throw the ball in said second direction.

4. The improvement of claim 3 and wherein:

said switch is arranged relative to said bracket and said motor to reduce the speed of the motor in response to movement of said bracket toward said second position.

5. The improvement of claim 4 and wherein:

said switch is arranged relative to said bracket and said motor to increase the speed of the motor in response to movement of said bracket toward said first position.

6. The improvement of claim 1 and further comprising:

a handle on one of said bracket and said support member and operable by the throwing device operator to slide said bracket relative to said support member from said first position to said second position and effect a change-up throw from one trajectory to a higher trajectory.

7. The improvement of claim 6 and wherein:

said handle is mounted on and connected to said bracket for lifting said throwing device by a person and carrying the throwing device.

8. The improvement of claim 7 and further comprising:

a resilient member connected between said bracket and said support member and urging said bracket toward return from said second position to said first position.

9. The improvement of claim 1 and further comprising:

a base assembly supporting said support member above ground surface.

10. In a ball throwing device comprising:

a support member, a wheel mounted on the support member above ground for rotation in a first plane about an axis perpendicular to said plane and wherein the wheel has a perimeter surface that is circular and is centered on said axis and faces outward away from said axis for engagement of a ball when placed on said surface, a motor for rotating the wheel on said axis for enabling the said surface of the wheel to throw said ball in a first direction in said first plane at a speed predetermined to project said ball from the surface of the wheel at a selected velocity;

a bracket attached to said support member;

a ball feed chute mounted to said bracket and radially spaced from said axis at a distance greater than the distance of said perimeter surface of the wheel from said axis;

and a pad secured to said bracket and having a ball-engagable surface spaced radially outward from said perimeter surface of the wheel a distance slightly less than the diameter of a ball to be thrown, for compressing the ball against the wheel;

the improvement comprising:

attachment of the bracket to the support member for guided movement of said bracket relative to support member from a first position to a second position to change the direction of throw of said ball in said first plane to a second direction in said first plane;

a motor control switch coupled to said motor and responsive to movement of said bracket relative to said support member from said first position to said second position to change the speed of said motor; and wherein said bracket has said first position placing said feed chute relative to said support member to cause said wheel to throw the ball in said first direction; and said bracket has said second position placing said feed chute relative to said support member to cause said wheel to throw said ball in said second direction upward from said first direction.

11. The improvement of claim 10 and wherein:

slots are provided in said support member; and fasteners connecting said bracket to said support member have shafts received in said slots for guiding said bracket relative to said support member from said first position to said second position.

12. The improvement of claim 11 and wherein:

said slots are elongate in the direction of lines in a plane parallel to said first plane and tangent to circles centered on said axis to place said feed chute at substantially the same distance from said perimeter surface of said wheel in both said first position of said bracket and said second position of said bracket.

13. The improvement of claim 11 and further comprising:

a motor control circuit coupled to said motor and responsive to movement of said bracket relative to said support member to change the speed of said motor.

14. The improvement of claim 10 and further comprising:

an electrical motor control circuit; and wherein:

said motor control switch is connected to said control circuit and is operable from a first switch condition when said bracket is in said first position, to a second switch condition when said bracket moves to said second position, to add resistance in an electrical supply to said motor to reduce speed of said motor.

15. The improvement of claim 14 and wherein:

an adjustment device is coupled to said electrical supply for adjustment of the amount of said added resistance.

16. A kit of parts for adding a performance feature to a ball throwing device which has a base member a support member mounted on the base member, a motor and a motor-powered ball-throwing wheel mounted for rotation by said motor about an axis on the support member and which has a ball receiver perimeter surface which is circular about said axis, and a ball feed chute to deliver a ball to said surface of the wheel to be thrown by the wheel, the kit comprising:

a feed chute bracket to be mounted for sliding on said support member;

a handle for moving said bracket in a path centered by said axis and spaced outboard of said surface around said wheel to change the direction of a ball when thrown by the wheel;

a motor control device associated with said bracket for operation in concert with movement of said bracket from a first position relative to said support member to a second position relative to said support member to change motor speed to change trajectory from that of one ball thrown by the wheel during said first bracket position to the trajectory of another ball thrown by the wheel during said second bracket position.

17. The kit of claim 16 and further comprising:

a pad for mounting on the support member and having a ball-engaging face for positioning radially outward from the ball-engaging surface of the wheel a distance slightly less than the diameter of a ball to be thrown, for compressing the ball against the wheel.

18. The kit of claim 16 and wherein said control device comprises:

a mechanically-operated electrical switch for coupling to said motor and associated with said handle for change of switch condition during movement of said bracket.

19. The kit of claim 18 and wherein:

said switch is mounted on said bracket.

20. The improvement of claim 19 and wherein:

said guides are slots in said support member and oriented to guide movement of said bolts sliding in said guides when said bracket moves between said first position and said second position to maintain the distance of said bracket from said access in both said first position of said bracket and in said second position of said bracket relative to said support member.

21. The kit of claim 16 and wherein said control device comprises:

a motor controller for electrically coupling to said motor and to said bracket.

22. The kit of claim 16 and further comprising:

at least one guide for fastening to said support member for guiding movement of said bracket between a first position and a second position of said bracket relative to said support member.

23. The kit of claim 22 and wherein:

said guide includes means for enabling said guide to be fixed to and integrated with said support member; and said guide has slots for reception of fasteners to be received in said slots and secured to said bracket whereby said bracket can be connected to and slide on said support member and; wherein said slots are oriented to guide movement of said fasteners in said slots when said bracket moves between said first position and said second position, to maintain the distance of said bracket from said axis in both said first position of said bracket and in said second position of said bracket relative to said support member.

* * * * *